US009913332B2

(12) United States Patent
Kuang et al.

(10) Patent No.: US 9,913,332 B2
(45) Date of Patent: Mar. 6, 2018

(54) TWO-CHANNEL LED DRIVER AND THE CONTROL METHOD THEREOF

(71) Applicant: Chengdu Monolithic Power Systems Co., Ltd., Chengdu (CN)

(72) Inventors: Naixing Kuang, Hangzhou (CN); Kai Wang, Hangzhou (CN)

(73) Assignee: Chengdu Monolithic Power Systems Co., Ltd., Chengdu (CN)

( * ) Notice: Subject to any disclaimer, the term of this patent is extended or adjusted under 35 U.S.C. 154(b) by 0 days.

(21) Appl. No.: 15/629,623

(22) Filed: Jun. 21, 2017

(65) Prior Publication Data

US 2018/0007753 A1 Jan. 4, 2018

(30) Foreign Application Priority Data

Jun. 30, 2016 (CN) ..... 2016 1 0506239

(51) Int. Cl.
*H05B 33/08* (2006.01)

(52) U.S. Cl.
CPC ..... *H05B 33/0815* (2013.01); *H05B 33/089* (2013.01); *H05B 33/0845* (2013.01)

(58) Field of Classification Search
CPC H05B 37/02; H05B 37/0272; H05B 33/0815; H05B 33/0851; H05B 33/0809; H05B 33/0845; H05B 33/089; H05B 41/28; H02M 3/156; H02M 3/33507; H02M 3/33546; H02M 3/33569; H02M 2001/0003; Y02B 20/346
See application file for complete search history.

(56) References Cited

U.S. PATENT DOCUMENTS

| | | | | |
|---|---|---|---|---|
| 8,503,139 | B2 | 8/2013 | Yao et al. | |
| 8,670,255 | B2 * | 3/2014 | Gong | H02M 1/4225 363/89 |
| 8,896,214 | B2 | 11/2014 | Xu | |
| 8,975,831 | B1 * | 3/2015 | Szolusha | H05B 33/0851 315/291 |
| 9,078,327 | B2 * | 7/2015 | Livschitz | H05B 33/0848 |
| 9,392,654 | B2 * | 7/2016 | Peng | H05B 33/0815 |
| 9,661,700 | B2 | 5/2017 | Kuang et al. | |

* cited by examiner

*Primary Examiner* — Haissa Philogene
(74) *Attorney, Agent, or Firm* — Perkins Coie LLP

(57) ABSTRACT

A two-channel LED driver adopts one power stage to provide a constant drive current to drive a first channel LED and a second channel LED, and to provide a power supply voltages to power a smart module. The two-channel LED driver controls the total current flowing through the first channel LED and the second channel LED according to a first dimming signal input by users through the smart module, and controls the dimming ratio between the two channels according to a second dimming signal. The two-channel LED driver provides high performance with simple circuit structure.

20 Claims, 7 Drawing Sheets

TWO-CHANNEL LED DRIVER AND THE CONTROL METHOD THEREOF

CROSS-REFERENCE TO RELATED APPLICATIONS

This application claims priority to and the benefit of Chinese Patent Application No. 201610506239.5, filed Jun. 30, 2016, which is incorporated herein by reference in its entirety.

FIELD

The present invention relates to electronic circuits, more specifically, the present invention relates to two-channel LED drivers.

BACKGROUND

As the development of technology, conventional fluorescent lamps are gradually replaced by LEDs (light emitting diodes) in applications such as LCD backlighting and lighting. In the application of smart LED lighting, a driver is needed to provide a controllable current. Different power supply voltages, such as 3.3V, 5V etc. are also needed to power smart modules (e.g. microcontroller unit (MCU), wireless module R/F, etc.) at different situations.

Conventional two-channel LED drivers typically adopt two power stages: a first stage including a converter (e.g. a flyback converter) to provide two constant voltages, with one voltage used to drive the LEDs, and the other voltage used to power other modules; and a second stage including two step-down converters, to control the current flowing through the LEDs in the two channels, respectively.

However, such two-channel LED driver with two power stages has complicated circuit structure, large volume and high cost.

SUMMARY

It is an object of the present invention to provide a two-channel LED driver, which resolves above problems.

In accomplishing the above and other objects, there has been provided, in accordance with an embodiment of the present invention, a two-channel LED driver, comprising: a power converter, configured to provide a drive current to drive a first channel LED and a second channel LED in response to an input voltage, the power converter including a first winding and a main power switch; a second winding, magnetically coupled to the first winding to provide a power supply voltage to power a wireless control module; an error amplifier, configured to generate a compensation signal in response to a reference signal and an equivalent output current indicative of the drive current, the reference signal being controlled by a first dimming signal; a control and drive circuit, configured to generate a control signal to control the main power switch in response to the compensation signal; a first dimming switch, coupled to the first channel LED to dim the first channel LED; and a second dimming switch, coupled to the second channel LED to dim the second channel LED, the first dimming switch and the second dimming switch being both controlled by a second dimming signal, and the second dimming switch being controlled to be turned on and off complementary with the first dimming switch.

In addition, there has been provided, in accordance with an embodiment of the present invention, a control method used in a two-channel LED driver, comprising: generating a drive current to drive a first channel LED and a second channel LED and generating a power supply to power a wireless control module in response to an input voltage; controlling a total current flowing through the first channel LED and the second channel LED according to a first dimming signal; synchronizing a second dimming signal with the input voltage to generate a synchronous signal; and controlling a dimming ratio of the first channel LED and the second channel LED according to the synchronous signal.

Furthermore, there has been provided, in accordance with an embodiment of the present invention, a two-channel LED driver, comprising: a power converter including a main power switch, configured to provide a drive current to drive a first channel LED and a second channel LED, and a power supply voltage to power a wireless control module; a control and drive circuit, configured to control the main power switch based on a reference signal and an equivalent output current indicative of the drive current, the reference signal being controlled by a first dimming signal; and a first dimming switch and a second dimming switch, configured to dim the first channel LED and the second channel LED, respectively, the first dimming switch and the second dimming switch being both controlled by a second dimming signal, and the second dimming switch being controlled to be turned on and off complementary with the first dimming switch.

The use of the similar reference label in different drawings indicates the same of like components.

DETAILED DESCRIPTION

Embodiments of circuits for two-channel LED driver are described in detail herein. In the following description, some specific details, such as example circuits for these circuit components, are included to provide a thorough understanding of embodiments of the invention. One skilled in relevant art will recognize, however, that the invention can be practiced without one or more specific details, or with other methods, components, materials, etc.

The following embodiments and aspects are illustrated in conjunction with circuits and methods that are meant to be exemplary and illustrative. In various embodiments, the above problem has been reduced or eliminated, while other embodiments are directed to other improvements.

Figure 1:
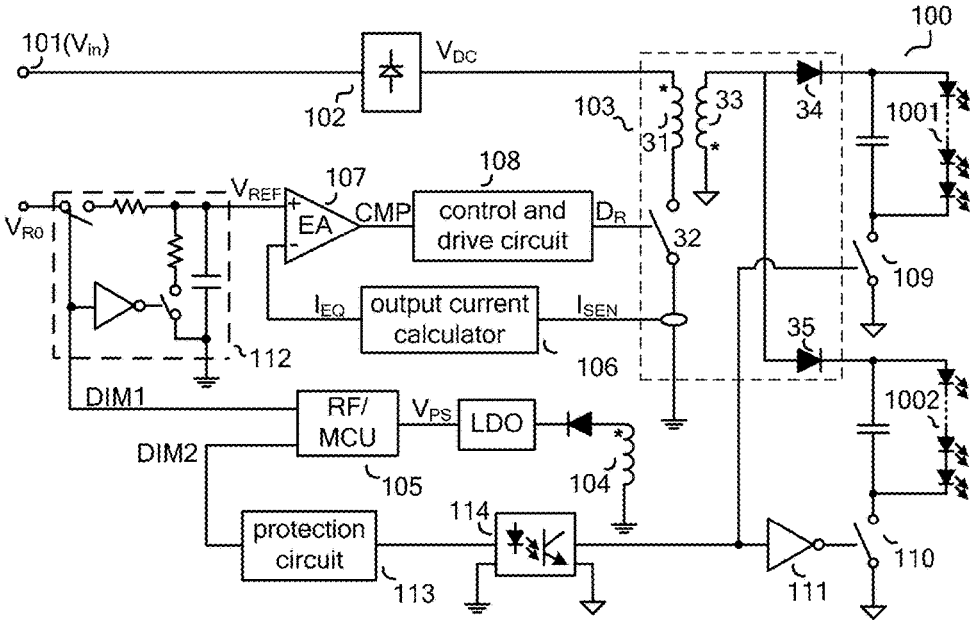
FIG. 1 schematically shows a two-channel LED driver 100 in accordance with an embodiment of the present invention.

FIG. 1 schematically shows a two-channel LED driver 100 in accordance with an embodiment of the present invention. The so-called two-channel in the present invention means that two LEDs and/or two LED strings are coupled to the driver in parallel. In the example of FIG. 1, the two-channel LED driver 100 is operable to drive a first channel LED 1001 and a second channel LED 1002, the two-channel LED driver 100 comprises: an input port 101, configured to receive an AC input voltage $V_{in}$; a rectifier 102, configured to receive the AC input voltage $V_{in}$ to provide a rectified signal $V_{DC}$; a power converter 103, configured to provide a drive current to drive the first channel LED 1001 and the second channel LED 1002, the power converter 103 including a first winding 31 and a main power switch 32 coupled to the first winding 31, wherein the first winding 31 is configured to store energy when the main power switch 32 is ON, and is configured to release the energy to the first and second channel LEDs when the main power switch 32 is OFF; a second winding 104, magnetically coupled to the first winding 31 to provide a power supply voltage $V_{PS}$ to power a wireless control module (RF/MCU) 105; an output current calculator 106, configured to calculate a total current flowing through the first channel LED and the second channel LED based on a current flowing through the main power switch 32, to generate an equivalent output current $I_{EQ}$; an error amplifier (EA) 107, configured to receive a reference signal $V_{REF}$ and the equivalent output current $I_{EQ}$, to generate a compensation signal CMP by amplifying and integrating a difference between the reference signal $V_{REF}$ and the equivalent output current $I_{EQ}$, the reference signal $V_{REF}$ being controlled by a first dimming signal DIM1 from the wireless control module 105; a control and drive circuit 108, configured to receive the compensation signal CMP to generate a control signal Dr to control the main power switch 32; a first dimming switch 109, coupled to the first channel LED 1001, to dim the first channel LED 1001; and a second dimming switch 110, coupled to the second channel LED 1002, to dim the second channel LED 1002; wherein the first dimming switch 109 and the second dimming switch 110 are both controlled by a second dimming signal DIM2 from the wireless control module 105, and the second dimming switch 110 is controlled to be turned on and off complementary with the first dimming switch 109, i.e., the second dimming switch 110 is controlled by an inverted signal of the second dimming signal DIM2.

In one embodiment, the first dimming signal DIM1 and the second dimming signal DIM2 are both PWM (pulse width modulation) signals.

In one embodiment, the power converter 103 further comprises: a secondary winding 33, magnetically coupled to the first winding 31; a first secondary power switch 34, coupled between the secondary winding 33 and the first channel LED 1001; and a second secondary power switch 35, coupled between the secondary winding 33 and the second channel LED 1002.

In the example of FIG. 1, the two-channel LED driver 100 further comprises: an inverter 111, configured to receive the second dimming signal DIM2 to generate its inverted signal.

In the example of FIG. 1, the two-channel LED driver 100 further comprises: a reference signal generator 112, configured to receive an original reference voltage $V_{R0}$ and the first dimming signal DIM1, to generate the reference signal $V_{REF}$. In one embodiment, the reference signal generator 112 generates the reference signal $V_{REF}$ by multiplying the original reference voltage $V_{R0}$ with a duty cycle of the first dimming signal DIM1, i.e., the reference signal $V_{REF}$, the original reference voltage $V_{R0}$ and the duty cycle of the first dimming signal DIM1 have a relationship as:

$$V_{REF}=V_{R0}\times D_{DIM1}$$

wherein $D_{DIM1}$ represents the duty cycle of the first dimming signal DIM1.

In one embodiment, the two-channel LED driver 100 further comprises: a protection circuit 113, configured to deliver the second dimming signal DIM2 to the first and second dimming switches (109 & 110), wherein the protection circuit 113 is operable to protect the two-channel LED driver 100 if some bad situation (e.g. over voltage, over current, over temperature, etc.) happens, and to take no action on the second dimming signal DIM2 if the two-channel LED driver 100 operates normally, so that the second dimming signal DIM2 is delivered to post-stage circuits, to control the first dimming switch 109 and the second dimming switch 110.

In one embodiment, when the power converter adopts isolated topology (e.g., the flyback converter as shown in FIG. 1), the second dimming signal DIM2 is configured to control the first dimming switch 109 and the second dimming switch 110 by way of a photoelectric coupler 114. Because of the existence of the photoelectric coupler 114, the second dimming signal DIM2 is inverted. In some other embodiments, the power converter may adopt non-isolated topology, and no photoelectric coupler is needed, which will be further discussed in the embodiment of FIG. 5.

In one embodiment, the wireless control module 105 is powered by the power supply voltage $V_{PS}$ at the second winding 104 by way of a diode and a voltage regulator (e.g. a low dropout regulator, LDO). However, one skilled in the art should realize that, the voltage regulator may comprise other appropriate circuits.

Figure 2:
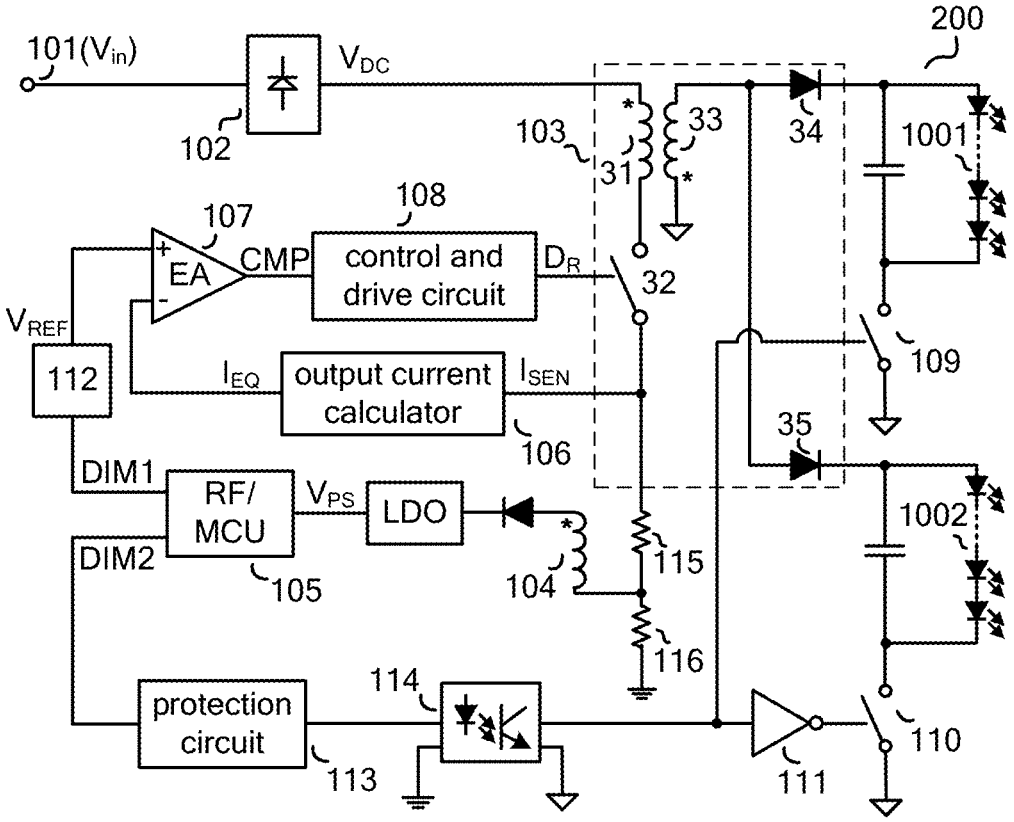
FIG. 2 schematically shows a two-channel LED driver 200 in accordance with an embodiment of the present invention.

FIG. 2 schematically shows a two-channel LED driver 200 in accordance with an embodiment of the present invention. The two-channel LED driver 200 in FIG. 2 is similar to the two-channel LED driver 100 in FIG. 1, with a difference that the two-channel LED driver 200 in FIG. 2 specifically shows the sense scheme of the current sense signal $I_{SEN}$. Specifically, the two-channel LED driver 200 in FIG. 2 further comprises: a first resistor 115 and a second resistor 116, series coupled between the main power switch 32 and a primary reference ground, wherein a voltage across the two series coupled resistors (115 & 116) is the current sense signal $I_{SEN}$, and wherein the second winding 104 is coupled to the reference ground/primary reference ground by way of the second resistor 116. The voltage across the two series coupled resistors (115 & 116) is then converted to the equivalent output current $I_{EQ}$ which reflects the total current flowing through the first channel LED 1001 and the second channel LED 1002 by the output current calculator 106.

During the constant current mode operation, when the main power switch 32 is turned off, the current flowing through the main power switch 32 is zero; and when the main power switch 32 is turned on, the current flowing through the main power switch 32 is:

$$I_{32} = I_{Lm} + \frac{N2}{N1} \times I_{104} \quad (1)$$

wherein $I_{32}$ represents the current flowing through the main power switch 32, $I_{Lm}$ represents the current flowing through a magnetization inductor of the first winding 31, $I_{104}$ indicates the current flowing through the second winding 104, and N2/N1 is the turn ratio between the second winding 104 and the first winding 31.

Thus, the voltage across the two series coupled resistors (i.e. the current sense signal $I_{SEN}$) is:

$$I_{SEN}=I_{32}\times(R_{115}+R_{116})-I_{104}\times R_{116} \quad (2)$$

wherein $R_{115}$ represents the resistance of the first resistor 115, and $R_{116}$ represents the resistance of the second resistor 116.

According to equation (1) and equation (2), the current sense signal $I_{SEN}$ is:

$$I_{SEN} = I_{Lm} \times (R_{115} + R_{116}) + I_{104} \times \left[\frac{N2}{N1} \times R_{115} - \left(1 - \frac{N2}{N1}\right) \times R_{116}\right]$$

As a result, if the relationship of the turn ratio between the second winding 104 and the first winding 31, and the resistances of the first resistor 115 and the second resistor 116 is set as:

$$\frac{N2}{N1} \times R_{115} = \left(1 - \frac{N2}{N1}\right) \times R_{116} \quad (3)$$

Then $$I_{SEN}=I_{LM}\times(R_{115}+R_{116}) \quad (4)$$

As can be seen from equations (3) and (4), if the relationship of the turn ratio between the second winding 104 and the first winding 31, and the resistances of the first resistor 115 and the second resistor 116 is particularly set as equation (3), the current sense signal $I_{SEN}$ is only related to the current flowing through the magnetization inductor of the first winding 31, but not affected by the current flowing through the second winding 104. The current sense signal $I_{SEN}$ is then converted to the equivalent output current $I_{EQ}$, so as to accurately reflect the total current flowing through the first channel LED 1001 and the second channel LED 1002.

The other circuit configuration and the operation principle of the two-channel LED driver 200 in FIG. 2 are similar to the two-channel LED driver 100 in FIG. 1.

Figure 3:
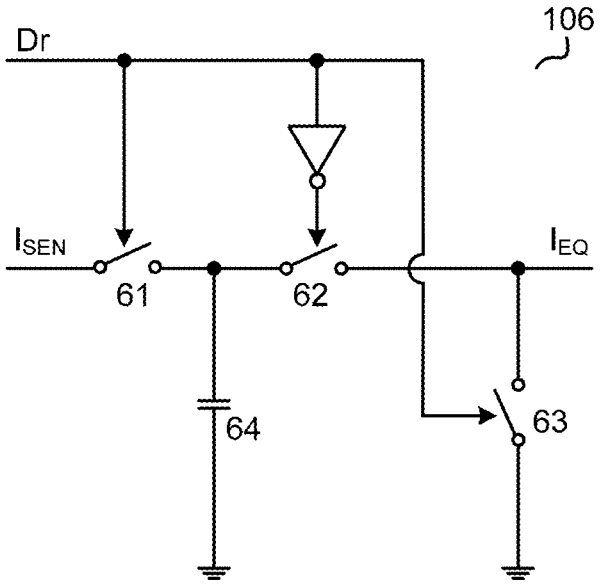
FIG. 3 schematically shows a circuit configuration of the output current calculator 106 in accordance with an embodiment of the present invention.

FIG. 3 schematically shows a circuit configuration of the output current calculator 106 in accordance with an embodiment of the present invention. In the example of FIG. 3, the output current calculator 106 comprises: switches 61-63 and a capacitor 64, wherein the operations of the switches 61-63 are all related to the control signal Dr. When the main power switch 32 is ON, the switches 61 and 63 are ON, and the switch 62 is OFF. Accordingly, the equivalent output current $I_{EQ}$ is zero; and a voltage across the capacitor 64 is the current sense signal $I_{SEN}$. When the main power switch 32 is OFF, the switches 61 and 63 are OFF, and the switch 62 is ON. Accordingly, the equivalent output current $I_{EQ}$ is the voltage across the capacitor 64, which is equal to a peak value of the current sense signal $I_{SEN}$.

The equivalent output current $I_{EQ}$ is then delivered to the error amplifier 107, so that the equivalent output current $I_{EQ}$ is regulated to the reference signal $V_{REF}$, which is controlled by the first dimming signal DIM1. Thus, the total current flowing through the first channel LED and the second channel LED (i.e. the total brightness of the LED) is regulated by the first dimming signal DIM1 in the two-channel LED drivers 100 and 200.

The first dimming switch 109 and the second dimming switch 110 are controlled by the second dimming signal DIM2, and the first dimming switch 109 and the second dimming switch 110 are turned on and off complementary (i.e. the first channel LED 1001 and the second channel LED 1002 are lighted complementary), so the second dimming signal DIM2 regulates the dimming ratio of each channel. For example, if the second dimming signal DIM2 has a duty cycle of 40%, after the conversion of the photoelectric coupler 114, the first channel LED 1001 will have a dimming ratio of 60%, and the second channel LED 1002 will have a dimming ratio of 40%. That is, in one switching cycle, the light time of the first channel LED 1001 occupies 60%, and the light time of the second channel LED 1002 occupies 40%.

Thus, the previous two-channel LED drivers 100 and 200 adopt only one power stage to drive the two channels of the LED, control the total current flowing through the two channels and the dimming ratio between the two channels, and power the wireless control module.

Figure 4:
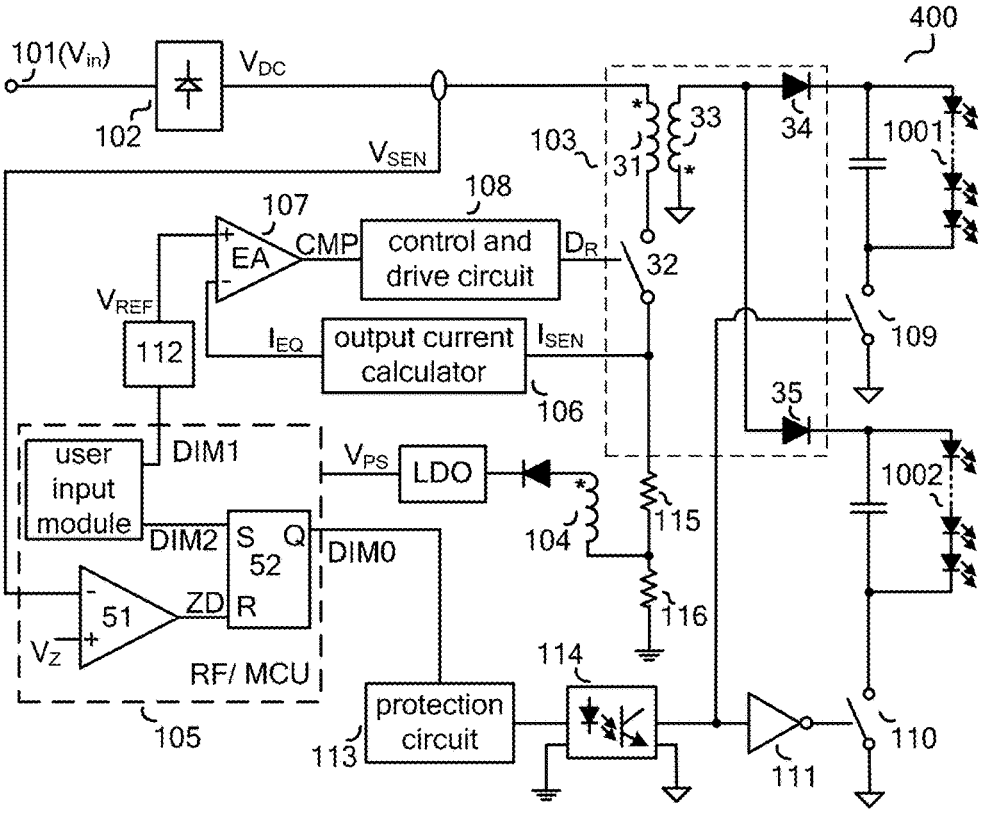
FIG. 4 schematically shows a two-channel LED driver 400 in accordance with an embodiment of the present invention.

FIG. 4 schematically shows a two-channel LED driver 400 in accordance with an embodiment of the present invention. The two-channel LED driver 400 in FIG. 4 is similar to the two-channel LED driver 100 in FIG. 1, with a difference that in the example of FIG. 4, the second dimming signal DIM2 is synchronized with the AC input voltage $V_{in}$ (or the rectified signal $V_{DC}$) by the wireless control module (RF/MCU) 105. Specifically, the wireless control module 105 comprises: a zero comparator 51, configured to receive an input sense signal $V_{SEN}$ indicative of the AC input voltage $V_{in}$ (or indicative of the rectified signal $V_{DC}$) and a zero reference voltage $V_Z$ (e.g. 0.1V), wherein the zero comparator 51 is configured to generate a zero detecting signal ZD by comparing the input sense signal $V_{SEN}$ with the zero reference voltage $V_Z$; a RS flip-flop 52, configured to receive the second dimming signal DIM2 input by users and the zero detecting signal ZD, to generate a synchronous dimming signal DIM0, to control the first dimming switch 109 and the second dimming switch 110, wherein the synchronous dimming signal DIM0 is set in response to the second dimming signal DIM2, and is reset in response to the zero detecting signal ZD, and wherein the reset has priority.

The other circuit configuration and the operation principle of the two-channel LED driver 400 in FIG. 4 are similar to the two-channel LED driver 100 in FIG. 1.

Several embodiments of the foregoing two-channel LED drivers (100, 200, & 400) adopt an isolated power converter. However, one with ordinary skill in the art should realize that the power converter in the two-channel LED driver may also adopt a non-isolated power converter, as shown in FIG. 5.

Figure 5:
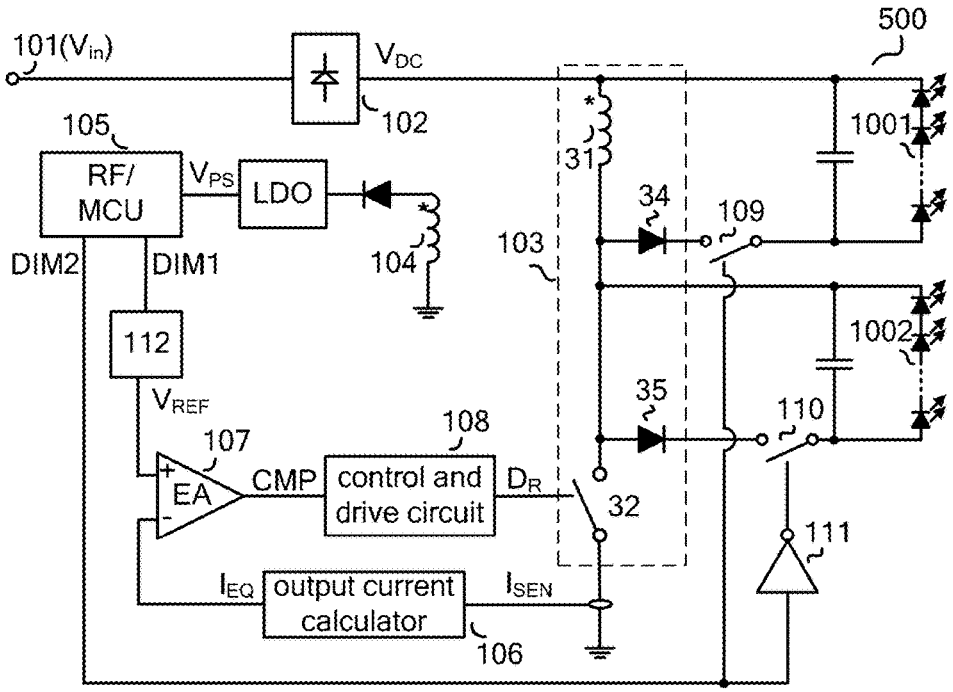
FIG. 5 schematically shows a two-channel LED driver 500 in accordance with an embodiment of the present invention.

FIG. 5 schematically shows a two-channel LED driver 500 in accordance with an embodiment of the present invention. In the example of FIG. 5, the power converter 103 in the two-channel LED driver 600 comprises a buck-boost converter. Specifically, the buck-boost converter comprises: a first winding 31; a main power switch 32, coupled to the first winding 31, wherein the first winding 31 is configured to store energy when the main power switch 32 is ON and is configured to release the energy to the first channel LED 1001 and second channel LED 1002 when the main power switch 32 is OFF; a first secondary power switch 34, coupled to the first winding 31 and the main power switch 32; and a second secondary power switch 35, coupled to the first winding 31 and the main power switch 32.

In the example of FIG. 5, the buck-boost converter is adopted, so the first dimming switch 109 and the second dimming switch 110 are configured as high-side switches, and floating drives are needed.

The other circuit configuration and the operation principle of the two-channel LED driver 500 in FIG. 5 are similar to the two-channel LED driver 100 in FIG. 1.

Figure 6:
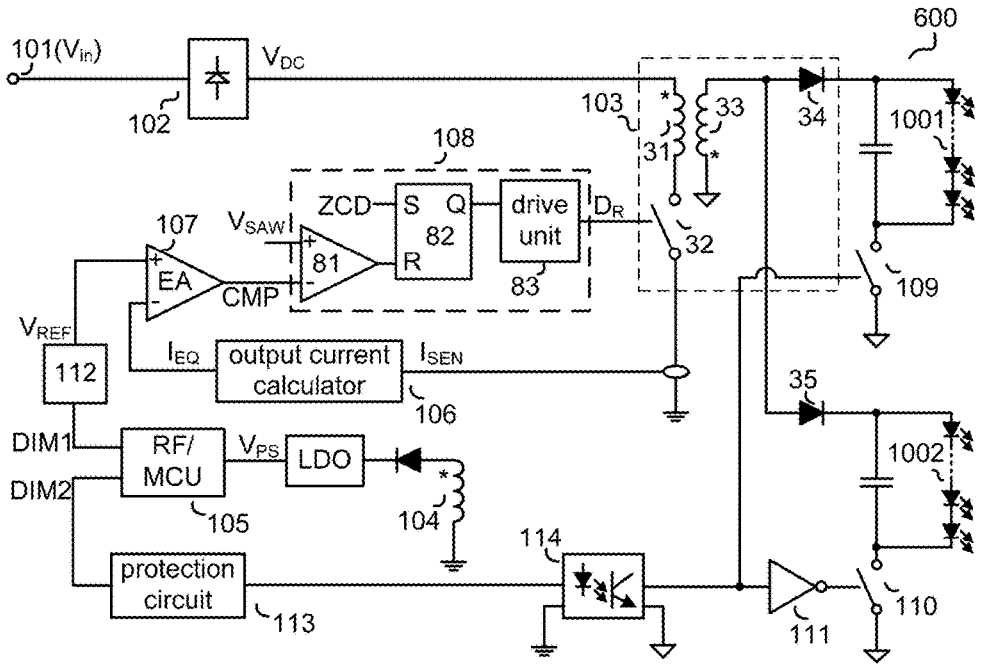
FIG. 6 schematically shows the two-channel LED driver with a circuit configuration of the control and drive circuit 108 in accordance with an embodiment of the present invention.

FIG. 6 schematically shows the two-channel LED driver with a circuit configuration of the control and drive circuit 108 in accordance with an embodiment of the present invention. In the example of FIG. 6, the control and drive circuit 108 comprises: a comparator 81, configured to receive the compensation signal CMP and a saw-tooth signal $V_{SAW}$, wherein the saw-tooth signal $V_{SAW}$ increases linearly when the main power switch 32 is ON, and is reset when the main power switch 32 is OFF, and wherein the comparator 21 is configured to generate a comparison signal by comparing the compensation signal CMP with the saw-tooth signal $V_{SAW}$; a logic circuit 82, configured to receive a zero crossing signal ZCD indicative of a zero crossing condition of a current flowing through the secondary power switch 34 and the comparison signal, to generate a logic signal, wherein the logic signal is set in response to the zero crossing signal ZCD and is reset in response to the comparison signal; and a drive unit 83, configured to receive the logic signal to generate the control signal Dr, so as to control the operation of the main power switch 32.

In one embodiment, the zero crossing condition is detected by way of a third winding (not shown).

In one embodiment, the logic circuit 82 comprises a RS flip-flop.

Several embodiments of the foregoing two-channel LED driver provide a constant drive current to the load, i.e., the driver operates under constant current mode. But if the user wants to turn off the LED, the wireless control module still needs a power supply voltage. Then the driver needs to provide a constant power supply voltage, i.e., the driver needs to operate under constant voltage mode.

Figure 7:
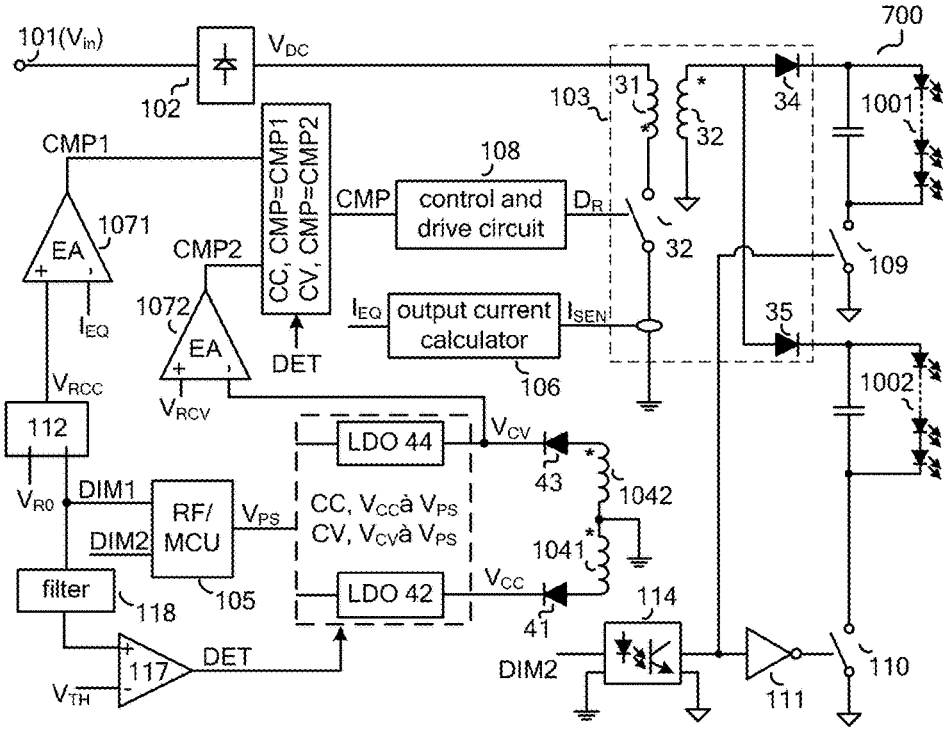
FIG. 7 schematically shows a two-channel LED driver 700 in accordance with an embodiment of the present invention.

FIG. 7 schematically shows a two-channel LED driver 700 in accordance with an embodiment of the present invention. The two-channel LED driver 700 operates under constant current mode or constant voltage mode according to different requirements from the user. Specifically, in the example of FIG. 7, the two-channel LED driver 700 comprises: an input port 101, configured to receive an AC input voltage $V_{in}$; a rectifier 102, configured to receive the AC input voltage $V_{in}$ to provide a rectified signal $V_{DC}$; a power converter 103, configured to provide drive currents to drive a first channel LED 1001 and a second channel LED 1002, the power converter 103 including a first winding 31 and a main power switch 32 coupled to the first winding 31, wherein the first winding 31 is configured to store energy when the main power switch 32 is ON, and is configured to release the energy to the first channel LED 1001 and second channel LED 1002 when the main power switch 32 is OFF; a second winding 1041, magnetically coupled to the first winding 31 to provide a first power supply voltage $V_{CC}$; a third winding 1042, magnetically coupled to the first winding 31 to provide a second power supply voltage $V_{CV}$; a threshold comparator 117, configured to receive a first dimming signal DIM1 from a wireless control module (RF/MCU) 105 and a threshold signal $V_{TH}$, wherein the threshold comparator 117 is configured to compare the first dimming signal DIM1 with the threshold signal $V_{TH}$ to generate a detecting signal DET; an output current calculator 106, configured to calculate a total current flowing through the first channel LED 1001 and the second channel LED 1002 in response to a current flowing through the main power switch 32, to generate an equivalent output current $I_{EQ}$; a reference signal generator 112, configured to receive an original reference voltage $V_{R0}$ and the first dimming signal DIM1, to generate a first reference signal $V_{RCC}$; a first error amplifier (EA) 1071, configured to receive the first reference signal $V_{RCC}$ and the equivalent output current $I_{EQ}$, to generate a first compensation signal CMP1 by amplifying and integrating a difference between the first reference signal $V_{RCC}$ and the equivalent output current $I_{EQ}$; a second error amplifier (EA) 1072, configured to receive a second reference signal $V_{RCV}$ and the second power supply voltage $V_{CV}$, to generate a second compensation signal CMP2 by amplifying and integrating a difference between the second reference signal $V_{RCV}$ and the second power supply voltage $V_{CV}$; a control and drive circuit 108, configured to receive a compensation signal CMP (the first compensation signal CMP1 or the second compensation signal CMP2) to generate a control signal Dr to control the main power switch 32, wherein when the first dimming signal DIM1 is lower than the threshold signal $V_{TH}$, the detecting signal DET indicates that the system is under constant voltage (CV) mode, the first power supply voltage $V_{CC}$ and the first compensation signal CMP1 are blocked (are invalidated), the wireless control module (RF/MCU) 105 is powered by the second power supply voltage $V_{CV}$, and the control and drive circuit 108 generates the control signal Dr in response to the second compensation signal CMP2; and when the first dimming signal DIM1 is higher than the threshold signal $V_{TH}$, the detecting signal DET indicates that the system is under constant current (CC) mode, the second power supply voltage $V_{CV}$ and the second compensation signal CMP2 are blocked (are invalidated), the wireless control module (RF/MCU) 105 is powered by the first power supply voltage $V_{CC}$, and the control and drive circuit 108 generates the control signal Dr in response to the first compensation signal CMP1; a first dimming switch 109, coupled to the first channel LED 1001, to dim the first channel LED 1001; and a second dimming switch 110, coupled to the second channel LED 1002, to dim the second channel LED 1002; wherein the first dimming switch 109 and the second dimming switch 110 are both controlled by a second dimming signal DIM2 from the wireless control module 105, and the second dimming switch 110 is controlled to be turned on and off complementary with the first dimming switch 109.

When the first dimming signal DIM1 is lower than the threshold signal $V_{TH}$, the detecting signal DET indicates that the system is under constant voltage (CV) mode, a first voltage regulator (e.g. LDO) 42 and the first error amplifier 1071 are disabled, causing the first power supply voltage $V_{CC}$ and the first compensation signal CMP1 to be blocked. Then the wireless control module (RF/MCU) 105 is powered by the second power supply voltage $V_{CV}$ by way of a second voltage regulator (e.g. a LDO) 44. The difference between the second reference signal $V_{RCV}$ and the second power supply voltage $V_{CV}$ is amplified and integrated by the second error amplifier 1072, and the second compensation signal CMP2 is delivered to the control and drive circuit 108, to provide a constant power supply voltage to the wireless control module 105.

When the first dimming signal DIM1 is higher than the threshold signal $V_{TH}$, the detecting signal DET indicates that the system is under constant current (CC) mode, the LDO 44 and the second error amplifier 1071 are disabled, causing the second power supply voltage $V_{CV}$ and the second compensation signal CMP2 to be blocked. Then the wireless control module (RF/MCU) 105 is powered by the first power supply voltage $V_{CC}$ by way of the LDO 42. The difference between the first reference signal $V_{RCC}$ and the equivalent output current $I_{EQ}$ is amplified and integrated by the first error amplifier 1071, and the first compensation signal CMP1 is delivered to the control and drive circuit 108, to control the total current flowing through the first channel LED 1001 and the second channel LED 1002 (i.e. to control the brightness of the LEDs) and to provide a constant power supply voltage to the wireless control module 105.

In one embodiment, the second winding 1041 and the first winding 31 are coupled in a forward way. That is, when the main power switch 32 is ON, an induced voltage generated across the second winding 1041 is provided as the first power supply voltage $V_{CC}$ via a diode 41; and when the main power switch 32 is OFF, the induced voltage generated across the second winding 1041 is blocked by the diode 41.

In one embodiment, the third winding 1042 and the first winding 31 are coupled in a flyback way. That is, when the main power switch 32 is ON, an induced voltage generated across the third winding 1042 is blocked by a diode 43; and when the main power switch 32 is OFF, the induced voltage generated across the second winding 1042 is provided as the second power supply voltage $V_{CV}$ via the diode 43.

In one embodiment, the first dimming signal DIM1 is input by users, which may be in a PWM form. As shown in FIG. 7, the LED driver 700 further comprises: a filter 118, configured to receive the first dimming signal DIM1, to convert the first dimming signal DIM1 in the PWM form into an analog signal, so that the threshold comparator 117 compares the analog signal with the threshold signal $V_{TH}$ to generate the detecting signal DET.

In one embodiment, the wireless control module (RF/MCU) 105 in the two-channel LED driver 700 is operable to synchronize the second dimming signal DIM2 with the AC input voltage $V_{in}$ (or the rectified signal $V_{DC}$). The wireless control module (RF/MCU) 105 may comprise a zero comparator and a RS flip-flop as in the example of FIG. 4.

Figure 8:
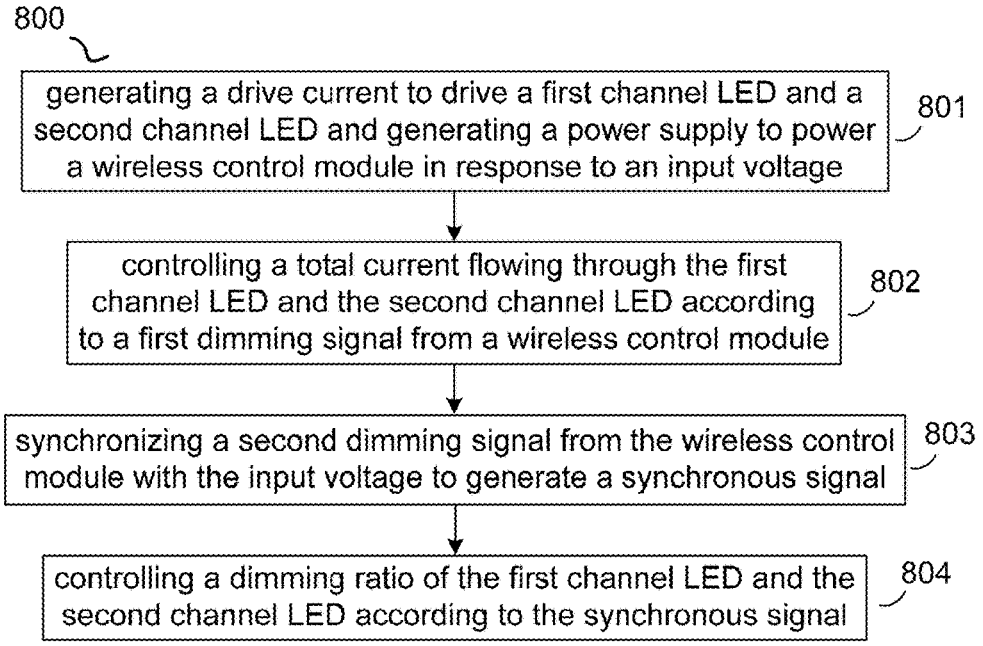
FIG. 8 schematically shows a flowchart 800 of a control method used in a two-channel LED driver in accordance with an embodiment of the present invention.

The present invention further provides a control method used in a two-channel LED driver. FIG. 8 schematically shows a flowchart 800 of a control method used in a two-channel LED driver in accordance with an embodiment of the present invention. The method comprises:

Step 801, generating a drive current to drive a first channel LED and a second channel LED and generating a power supply to power a wireless control module in response to an input voltage.

Step 802, controlling a total current flowing through the first channel LED and the second channel LED according to a first dimming signal.

Step 803, synchronizing a second dimming signal with the input voltage to generate a synchronous signal.

Step 804, controlling a dimming ratio of the first channel LED and the second channel LED according to the synchronous signal.

In one embodiment, synchronizing a second dimming signal with the input voltage to generate a synchronous signal comprises: detecting a zero crossing condition of the input voltage; resetting the synchronous signal when the zero crossing condition is detected; and setting the synchronous signal in response to the second dimming signal.

In one embodiment, the first channel LED is dimmed by the synchronous signal, and the second channel LED is dimmed by an inverted signal of the synchronous signal.

In one embodiment, the method further comprises: comparing the second dimming signal with a threshold signal; if the first dimming signal is higher than the threshold signal, entering constant current mode: providing a constant drive current to drive the first channel LED and the second channel LED, and providing a first power supply voltage to power a wireless control module; and if the first dimming signal is lower than the threshold signal, entering constant voltage mode: providing a second power supply voltage to power the wireless control module.

In one embodiment, the constant drive current, the first power supply voltage and the second power supply voltage are all provided by a power stage, and the power stage comprises: a first winding, a second winding and a third winding. When the system enters constant current mode, the first power supply voltage is provided by magnetically coupling the second winding to the first winding in a forward way. When the system enters constant voltage mode, the second power supply voltage is provided by magnetically coupling the third winding to the first winding in a flyback way.

In one embodiment, the power stage includes a main power switch, and wherein the LED drive method further comprises: deriving an equivalent output current indicative of the drive current; generating a first compensation signal in response to a first reference signal and the equivalent output current, the first reference signal being proportional to a duty cycle of the first dimming signal; generating a second compensation signal in response to a second reference signal and the second power supply voltage; and generating a control signal to control the main power switch in response to a) the first compensation signal when the dimming signal is higher than the threshold signal or b) the second compensation signal when the dimming signal is lower than the threshold signal.

It is to be understood in these letters patent that the meaning of "A" is coupled to "B" is that either A and B are connected to each other as described below, or that, although A and B may not be connected to each other as described above, there is nevertheless a device or circuit that is connected to both A and B. This device or circuit may include active or passive circuit elements, where the passive circuit elements may be distributed or lumped-parameter in nature. For example, A may be connected to a circuit element that in turn is connected to B.

This written description uses examples to disclose the invention, including the best mode, and also to enable a person skilled in the art to make and use the invention. The patentable scope of the invention may include other examples that occur to those skilled in the art.

What is claimed is:

1. A two-channel LED driver, comprising:

a power converter, configured to provide a drive current to drive a first channel LED and a second channel LED in response to an input voltage, the power converter including a first winding and a main power switch;

a second winding, magnetically coupled to the first winding to provide a power supply voltage to power a wireless control module;

an error amplifier, configured to generate a compensation signal in response to a reference signal and an equivalent output current indicative of the drive current, the reference signal being controlled by a first dimming signal;

a control and drive circuit, configured to generate a control signal to control the main power switch in response to the compensation signal;

a first dimming switch, coupled to the first channel LED to dim the first channel LED; and a second dimming switch, coupled to the second channel LED to dim the second channel LED, the first dimming switch and the second dimming switch being both controlled by a second dimming signal, and the second dimming switch being controlled to be turned on and off complementary with the first dimming switch.

2. The two-channel LED driver of claim 1, wherein the wireless control module comprises:

a zero comparator, configured to generate a zero detecting signal in response to a zero crossing of the input voltage; and a RS flip-flop, configured to generate a synchronous dimming signal to control the first dimming switch and the second dimming switch, wherein the synchronous dimming signal is set in response to the second dimming signal, and is reset in response to the zero detecting signal.

3. The two-channel LED driver of claim 1, further comprising:

an output current calculator, configured to calculate the drive current in response to a current flowing through the main power switch, to generate the equivalent output current.

4. The two-channel LED driver of claim 3, further comprising: a first resistor and a second resistor, series coupled between the main power switch and a primary reference ground; wherein:

a voltage across the two series coupled resistors indicates the current flowing through the main power switch; and the second winding is coupled to the primary reference ground by way of the second resistor.

5. The two-channel LED driver of claim 1, wherein the power converter further includes a secondary power switch, and wherein the control and drive circuit comprises:

a comparator, configured to compare the compensation signal with a saw-tooth signal, to generate a comparison signal, wherein the saw-tooth signal increases linearly when the main power switch is ON, and is reset when the main power switch is OFF;

a RS flip-flop, configured to generate a logic signal, wherein the logic signal is set in response to a zero crossing condition of a current flowing through the secondary power switch, and is reset in response to the comparison signal; and a drive unit, configured to generate the control signal in response to the logic signal, so as to control the operation of the main power switch.

6. The two-channel LED driver of claim 1, wherein the first dimming signal is in a PWM form and has a duty cycle, and wherein the two-channel LED driver further comprises:

a reference signal generator, configured to multiply an original reference voltage with the duty cycle of the first dimming signal, to generates the first reference signal.

7. The two-channel LED driver of claim 1, wherein the power supply voltage provided by the second winding is a first power supply voltage, the error amplifier is a first error amplifier, and the compensation signal provided by the error amplifier is a first compensation signal, and wherein the two-channel LED driver further comprises:

a third winding, magnetically coupled to the first winding to provide a second power supply voltage; and a second error amplifier, configured to generate a second compensation signal in response to a second reference signal and the second power supply voltage.

8. The two-channel LED driver of claim 7, wherein:

the wireless control module is powered by the first power supply voltage when the first dimming signal is higher than a threshold signal, and is powered by the second power supply voltage when the first dimming signal is lower than the threshold signal; and the control and drive circuit is configured to generate the control signal in response to the first compensation signal when the first dimming signal is higher than the threshold signal, and is configured to generate the control signal in response to the second compensation signal when the first dimming signal is lower than the threshold signal.

9. The two-channel LED driver of claim 1, further comprising:

a protection circuit, configured to deliver the second dimming signal to the first and second dimming switches, wherein the protection circuit is operable to protect the two-channel LED driver if some bad situation happens, and to take no action on the second dimming signal if the two-channel LED driver operates normally.

10. A control method used in a two-channel LED driver, comprising:

generating a drive current to drive a first channel LED and a second channel LED and generating a power supply to power a wireless control module in response to an input voltage;

controlling a total current flowing through the first channel LED and the second channel LED according to a first dimming signal;

synchronizing a second dimming signal with the input voltage to generate a synchronous signal; and controlling a dimming ratio of the first channel LED and the second channel LED according to the synchronous signal.

11. The LED drive method of claim 10, synchronizing a second dimming signal with the input voltage to generate a synchronous signal comprises:

detecting a zero crossing condition of the input voltage;

resetting the synchronous signal when the zero crossing condition is detected; and setting the synchronous signal in response to the second dimming signal.

12. The LED drive method of claim 10, further comprising:

comparing the second dimming signal with a threshold signal;

entering constant current mode if the first dimming signal is higher than the threshold signal: providing a constant drive current to drive the first channel LED and the second channel LED, and providing a first power supply voltage to power a wireless control module; and entering constant voltage mode if the first dimming signal is lower than the threshold signal: providing a second power supply voltage to power the wireless control module.

13. The LED drive method of claim 12, wherein the constant drive current, the first power supply voltage and the second power supply voltage are all provided by a power stage including a main power switch, and wherein the LED drive method further comprises:

deriving an equivalent output current indicative of the drive current;

generating a first compensation signal in response to a first reference signal and the equivalent output current, the first reference signal being proportional to a duty cycle of the first dimming signal;

generating a second compensation signal in response to a second reference signal and the second power supply voltage; and generating a control signal to control the main power switch in response to a) the first compensation signal when the first dimming signal is higher than the threshold signal; or b) the second compensation signal when the first dimming signal is lower than the threshold signal.

14. The LED drive method of claim 10, wherein the first dimming signal and the second dimming signal are input by users through the wireless control module.

15. A two-channel LED driver, comprising:

a power converter including a main power switch, configured to provide a drive current to drive a first channel LED and a second channel LED, and a power supply voltage to power a wireless control module;

a control and drive circuit, configured to control the main power switch based on a reference signal and an equivalent output current indicative of the drive current, the reference signal being controlled by a first dimming signal; and a first dimming switch and a second dimming switch, configured to dim the first channel LED and the second channel LED, respectively, the first dimming switch and the second dimming switch being both controlled by a second dimming signal, and the second dimming switch being controlled to be turned on and off complementary with the first dimming switch.

16. The two-channel LED driver of claim 15, wherein the wireless control module comprises:

a zero comparator, configured to generate a zero detecting signal in response to a zero crossing of the input voltage; and a RS flip-flop, configured to generate a synchronous dimming signal to control the first dimming switch and the second dimming switch, wherein the synchronous dimming signal is set in response to the second dimming signal, and is reset in response to the zero detecting signal.

17. The two-channel LED driver of claim 15, wherein the first dimming signal is in a PWM form and has a duty cycle, and wherein the two-channel LED driver further comprises:

a reference signal generator, configured to multiply an original reference voltage with the duty cycle of the first dimming signal to generates the reference signal.

18. The two-channel LED driver of claim 15, further comprising:

an output current calculator, configured to calculate the drive current in response to a current flowing through the main power switch, to generate the equivalent output current.

19. The two-channel LED driver of claim 18, further comprising: a first resistor and a second resistor, series coupled between the main power switch and a primary reference ground; wherein:

a voltage across the two series coupled resistors indicates the current flowing through the main power switch; and the second winding is coupled to the primary reference ground by way of the second resistor.

20. The two-channel LED driver of claim 15, further comprising:

a protection circuit, configured to deliver the second dimming signal to the first and second dimming switches, wherein the protection circuit is operable to protect the two-channel LED driver if some bad situation happens, and to take no action on the second dimming signal if the two-channel LED driver operates normally.

* * * * *